US005495625A

United States Patent [19]

McGuire

[11] Patent Number: 5,495,625

[45] Date of Patent: Mar. 5, 1996

[54] TOILET BOWL BIDET ATTACHMENT

[76] Inventor: Thayard A. McGuire, 11341 Blackbark Dr., Riverview, Fla. 33569

[21] Appl. No.: 354,467

[22] Filed: Dec. 12, 1994

[51] Int. Cl.[6] ..... E03D 9/08

[52] U.S. Cl. ..... 4/420.5; 4/420.2

[58] Field of Search ..... 4/420.4, 420.5, 4/447, 448, 420.2

[56] References Cited

U.S. PATENT DOCUMENTS

| | | | |
|---|---|---|---|
| 392,461 | 11/1888 | Reid | 4/420.5 X |
| 1,683,063 | 9/1928 | Campus | 4/420.5 |
| 1,752,782 | 4/1930 | Burton | 4/448 |
| 1,835,497 | 12/1931 | Kahn | 4/420.5 |
| 2,762,058 | 9/1956 | Hurko | 4/420.5 |
| 4,967,423 | 11/1990 | Aoyama | 4/420.4 |

FOREIGN PATENT DOCUMENTS

| | | | |
|---|---|---|---|
| 0565704 | 8/1957 | Italy | 4/420.4 |
| 1361097 | 7/1974 | United Kingdom | 4/420.5 |

*Primary Examiner*—Robert M. Fetsuga

[57] ABSTRACT

An attachment for rinsing the genital area of an individual. The device includes a water supply assembly couplable to hot and cold water supply lines and positionable in adjacency relative to a toilet. A nozzle conduit in fluid communication with the water supply assembly extends through an aperture in the toilet bowl to direct water onto the genital area of a user. The water supply assembly includes a pair of valves for hot and cold water. Each of the valves having a body with a hollow portion which receives respective toilet seat mounting bolts on opposing sides of the toilet bowl, and a handle extending from the valve body.

10 Claims, 3 Drawing Sheets

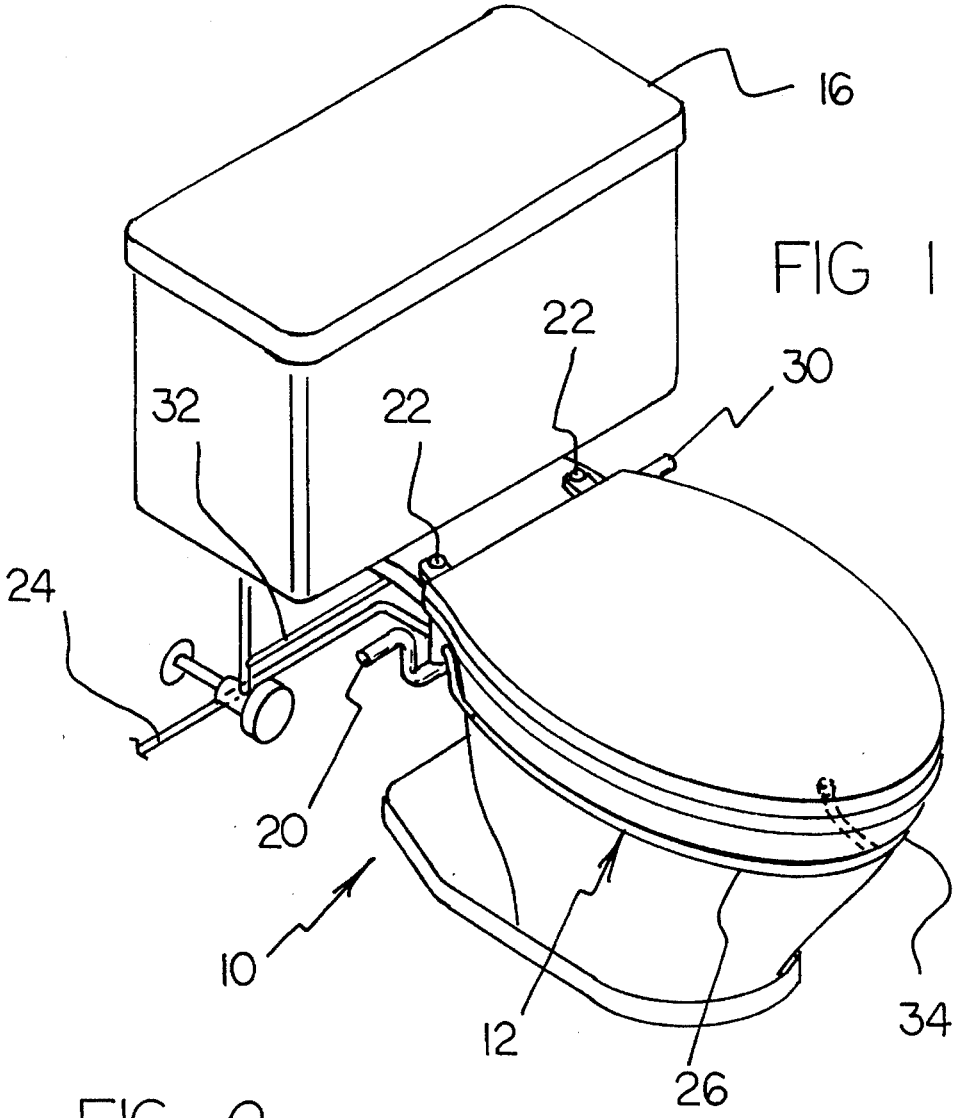
FIG 1
FIG 2
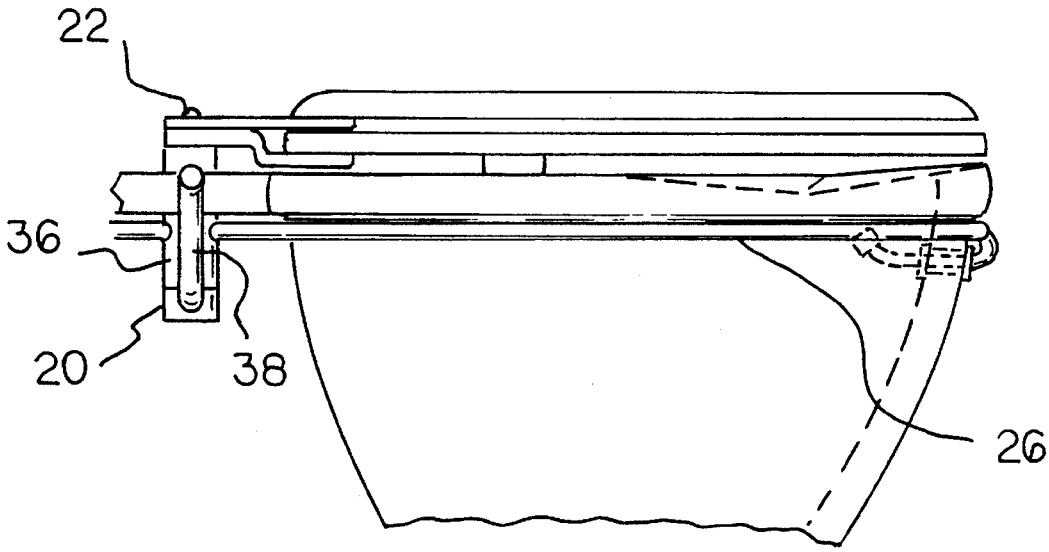

FIG 3
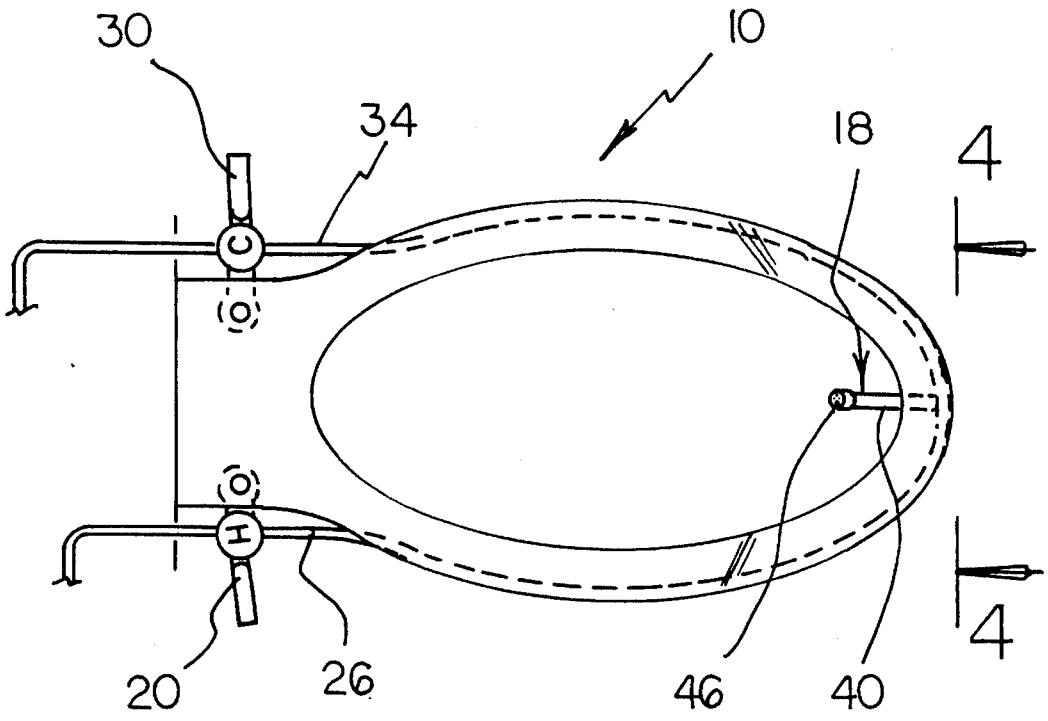
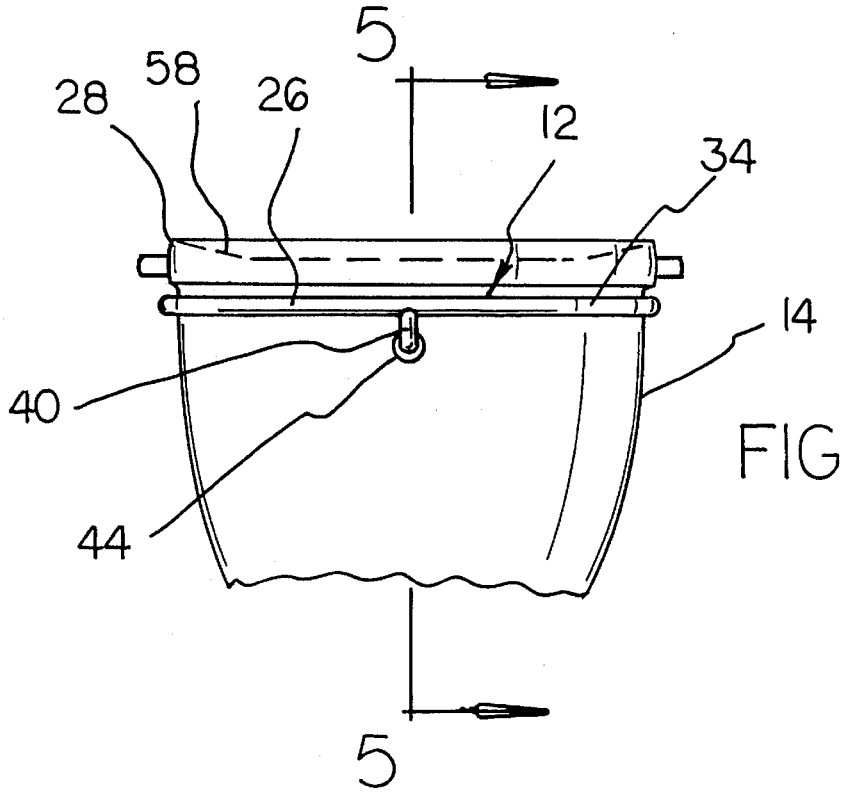
FIG 4

TOILET BOWL BIDET ATTACHMENT

BACKGROUND OF THE INVENTION

1. Field of the Invention

The present invention relates to toilet structures and more particularly pertains to a toilet bowl bidet attachment for rinsing a genital area of an individual.

2. Description of the Prior Art

The use of toilet structures is known in the prior art. More specifically, toilet structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet structures include U.S. Pat. No. 5,287,566; U.S. Pat. No. 5,279,001; U.S. Pat. No. 5,271,104; U.S. Pat. No. 5,142,711; U.S. Pat. No. 5,025,510; U.S. Pat. No. 4,924,534; and U.S. Pat. No. 4,181,985.

While these devices fulfill their respective, particular objectives and requirements, the aforementioned patents do not disclose a toilet bowl bidet attachment for rinsing the genital area of an individual which includes a water supply assembly couplable to hot and cold water supply lines and positionable into adjacency relative to a toilet, with a nozzle conduit in fluid communication with the water supply assembly extending through an aperture in the toilet bowl to direct water onto the genital area of a user.

In these respects, the toilet bowl bidet attachment according to the present invention substantially departs from the conventional concepts and designs of the prior art, and in so doing provides an apparatus primarily developed for the purpose of rinsing the genital area of an individual.

SUMMARY OF THE INVENTION

In view of the foregoing disadvantages inherent in the known types of toilet structures now present in the prior art, the present invention provides a new toilet bowl bidet attachment construction wherein the same can be utilized for rinsing the genital area of an individual. As such, the general purpose of the present invention, which will be described subsequently in greater detail, is to provide a new toilet bowl bidet attachment apparatus and method which has many of the advantages of the toilet structures mentioned heretofore and many novel features that result in a toilet bowl bidet attachment which is not anticipated, rendered obvious, suggested, or even implied by any of the prior art toilet structures, either alone or in any combination thereof.

To attain this, the present invention generally comprises an attachment for rinsing the genital area of an individual. The inventive device includes a water supply assembly couplable to hot and cold water supply lines and positionable in adjacency relative to a toilet. A nozzle conduit in fluid communication with the water supply assembly extends through an aperture in the toilet bowl to direct water onto the genital area of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet bowl bidet attachment apparatus and method which has many of the advantages of the toilet structures mentioned heretofore and many novel features that result in a toilet bowl bidet attachment which is not anticipated, rendered obvious, suggested, or even implied by any of the prior art toilet structures, either alone or in any combination thereof.

It is another object of the present invention to provide a new toilet bowl bidet attachment which may be easily and efficiently manufactured and marketed.

It is a further object of the present invention to provide a new toilet bowl bidet attachment which is of a durable and reliable construction.

An even further object of the present invention is to provide a new toilet bowl bidet attachment which is susceptible of a low cost of manufacture with regard to both materials and labor, and which accordingly is then susceptible of low prices of sale to the consuming public, thereby making such toilet bowl bidet attachments economically available to the buying public.

Still yet another object of the present invention is to provide a new toilet bowl bidet attachment which provides in the apparatuses and methods of the prior art some of the advantages thereof, while simultaneously overcoming some of the disadvantages normally associated therewith.

Still another object of the present invention is to provide a new toilet bowl bidet attachment for rinsing the genital area of an individual.

Yet another object of the present invention is to provide a new toilet bowl bidet attachment which includes a water supply assembly couplable to hot and cold water supply lines and positionable into adjacency relative to a toilet, with a nozzle conduit in fluid communication with the water supply assembly extending through an aperture in the toilet bowl to direct water onto the genital area of a user.

Even still another object of the present invention is to provide a new toilet bowl bidet attachment which can be easily coupled to an existing toilet bowl structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a toilet bowl bidet attachment according to the present invention as coupled to a toilet.

FIG. 2 is a side elevation view of the invention coupled to a toilet.

FIG. 3 is a top plan view of the invention in combination with a toilet structure.

FIG. 4 is a front elevation view as seen from line 4—4 of FIG. 3.

DESCRIPTION OF THE PREFERRED EMBODIMENT

Figure 5:
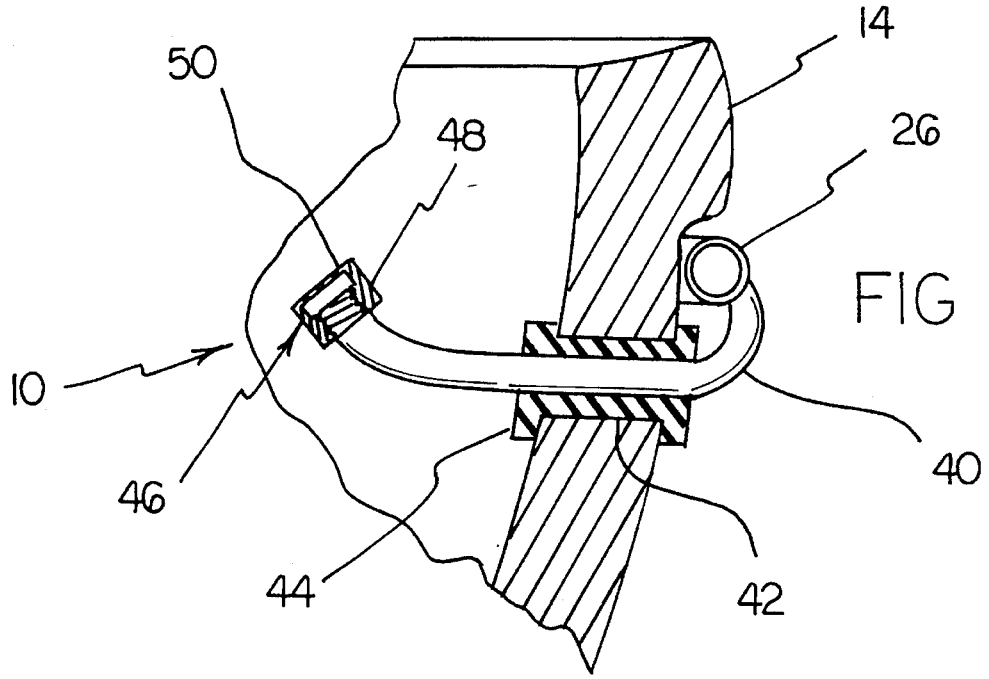
FIG. 5 is a cross sectional view taken along line 5—5 of FIG. 4.

With reference now to the drawings, and in particular to FIGS. 1–6 thereof, a new toilet bowl bidet attachment embodying the principles and concepts of the present invention and generally designated by the reference numeral 10 will be described.

More specifically, it will be noted that the toilet bowl bidet attachment 10 comprises a water supply means 12 for communicating with hot and cold water supply lines which can be positioned in adjacency to a toilet bowl 14 of a conventionally known toilet 16. A nozzle means 18 is positioned in fluid communication with the water supply means 12 and extends through the toilet bowl 114 for directing water from the water supply means onto the genital area of a user.

As best illustrated in FIGS. 1 through 4, it can be shown that the water supply means 12 according to the present invention 10 preferably comprises a first valve 20 mountable to a first toilet seat attaching bolt 22 extending through the toilet 16 to mount the first valve substantially behind and slightly beneath the toilet bowl 14 of the toilet 16. The first valve 20 is couplable to a hot water supply line 24, with the water supply means 12 further comprising a hot water conduit 26 of substantially arcuate configuration which extends about the toilet bowl 14 beneath a rim 28 thereof. Similarly, the water supply means 12 additionally comprises a second valve 30 mountable to another toilet seat attaching bolt of the toilet 16 and communicating with a cold water supply line 32, with the water supply means 12 further including a cold water conduit 34 (see FIG. 3) of substantially arcuate configuration extending about the toilet bowl 14 just beneath the rim 28 thereof. As shown in FIG. 4, the hot water conduit 26 is coupled to the cold water conduit 34 proximal to forward most end of the toilet bowl 14 whereat the nozzle means 18 extends into fluid communication with both the hot water conduit and the cold water conduit of the water supply means 12.

The valves 20 and 30 of the water supply means 12, as shown in FIG. 2, each comprise a substantially cylindrical valve body 36 having an unlabeled threaded bore receiving the toilet seat attaching bolt 22 therewithin. A handle 38 extending from the valve body 36 effects proportionate control of a volume of water through the valve through conventional valve components contained within the valves 20 and 30.

As best illustrated in FIGS. 3 through 5, it can be shown that the nozzle means 18 according to the present invention 10 preferably comprises a nozzle conduit 40 positioned in fluid communication with both the hot water conduit 26 and the cold water conduit 34 which extends through an aperture 42 in the toilet bowl 14. A grommet 44 is concentrically positioned about the nozzle conduit 40 and extends through the aperture 42 to form a sealing engagement with the toilet bowl 14 to preclude a passage of water or other fluids across a juncture of the nozzle conduit 40 and the toilet bowl 14. The nozzle conduit 40 extends into the toilet bowl 14 and is angled upward so as to terminate in a threaded distal end. A nozzle head 46 is threadably coupled to the threaded distal end of the nozzle conduit 40 and operates to modify or diffuse water dispensed through the nozzle conduit 40.

Figure 6:
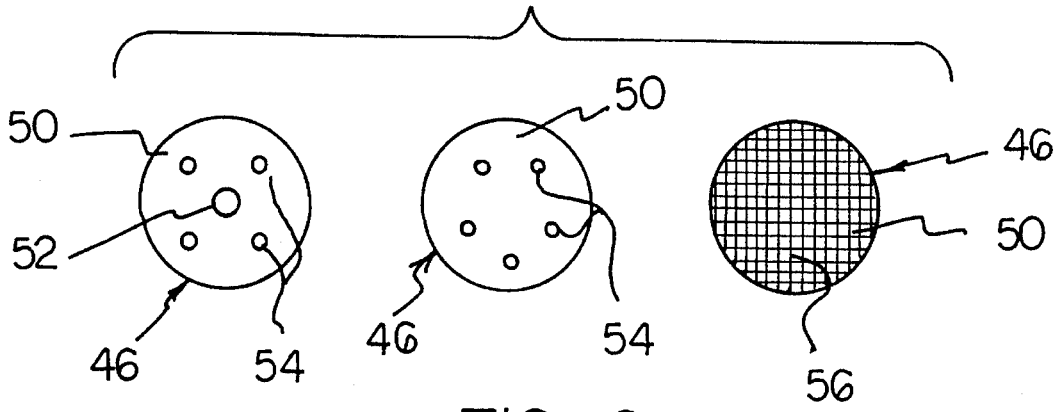
FIG. 6 is a plan view of a plurality of disparate nozzle heads for use with the present invention.

As shown in FIGS. 5 and 6, the nozzle head 46 preferably comprises a threaded cap 48 having a transverse circular panel 50 extending across the distal end of the nozzle conduit 40. FIG. 6 illustrates that the transverse circular panel 50 may have a variety of patterns of dispensing apertures extending therethrough. For example, a circular aperture 52 can be directed through a center of a transverse circular panel 50, with an annular array of smaller spray apertures 54 extending through the transverse circular panel 50 and about the center aperture 52. Alternatively, the transverse circular panel 50 may be provided with only the annular array of spray apertures 54, as shown in the center illustration of FIG. 6. Lastly, the transverse circular panel 50 may simply comprise a circular screen 56 extending across the threaded cap 48 of the nozzle head 46.

As shown in FIGS. 4 and 5, the present invention 10 may further comprise a toilet 16 wherein the rim 28 thereof is angled so as to direct fluids from an upper surface of the rim into the toilet bowl 14. To this end, an upper surface of the rim 28 is angled towards the interior of the toilet bowl 14 as at 58. Because the upper surface of the rim 28 is angled as at 58, overspray or the like created during use of the device 10 will be redirected back into the toilet bowl 14.

In use, the toilet bowl bidet attachment 10 can be easily attached to an existing toilet structure 16 to permit rinsing of the genital area of an individual. Because the valves 20 and 30 can be mounted to the toilet seat attaching bolts 22, the only modification required to the existing toilet 16 is the creation of an aperture 42 through the toilet bowl 14 as shown in FIG. 5. Thus, the present invention 10 can be easily sold as an add-on unit for use with existing toilet structures.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet bowl bidet attachment comprising:

a toilet having a toilet bowl;

a water supply means positioned in adjacency to the toilet bowl of the toilet for communicating with hot and cold water supply lines, the water supply means comprising a first valve mounted to a first toilet seat attaching bolt extending through the toilet to mount the first valve substantially behind and slightly beneath the toilet bowl of the toilet, the first valve being couplable to the hot water supply line; a hot water conduit of substantially arcuate configuration extending about the toilet bowl of the toilet beneath a rim thereof; a second valve mounted to a second toilet seat attaching bolt extending through the toilet to mount the second valve substantially behind and slightly beneath the toilet bowl of the toilet, the second valve being couplable to the cold water supply line; a cold water conduit of substantially arcuate configuration extending about the toilet bowl of the toilet beneath the rim thereof, the hot water conduit being in fluid communication with the cold water conduit, with the nozzle means extending into fluid communication with both the hot water conduit and the cold water conduit of the water supply means, each of the valves of the water supply means comprising a substantially cylindrical valve body, with the valve body receiving and engaging the respective toilet seat attaching bolt therewithin; and a handle extending from the valve body for effecting proportionate control of a volume of fluid through the valve; and, a nozzle means positioned in fluid communication with the water supply means and extending through an aperture in the toilet bowl of the toilet for directing water from the water supply means onto a genital area of a user.

2. A toilet bowl bidet attachment comprising:

a water supply means for communicating with hot and cold water supply lines and for positioning in adjacency to a toilet bowl of a toilet; and, a nozzle means positioned in fluid communication with the water supply means and extendable through an aperture in the toilet bowl of the toilet for directing water from the water supply means onto a genital area of a user;

wherein the water supply means comprises a first valve mountable to a first toilet seat attaching bolt extending through the toilet to mount the first valve substantially behind and slightly beneath the toilet bowl of the toilet, the first valve being couplable to the hot water supply line; a hot water conduit of substantially arcuate configuration for extending about the toilet bowl of the toilet beneath a rim thereof; a second valve mountable to a second toilet seat attaching bolt extending through the toilet to mount the second valve substantially behind and slightly beneath the toilet bowl of the toilet, the second valve being couplable to the cold water supply line; a cold water conduit of substantially arcuate configuration for extending about the toilet bowl of the toilet beneath the rim thereof, the hot water conduit being in fluid communication with the cold water conduit, with the nozzle means extending into fluid communication with both the hot water conduit and the cold water conduit of the water supply means;

wherein the nozzle means comprises a nozzle conduit positioned in fluid communication with both the hot water conduit and the cold water conduit, the nozzle conduit being positionable through the aperture in the toilet bowl of the toilet; a grommet concentrically positioned about the nozzle conduit and extendable through an aperture of the toilet to form a sealing engagement with the toilet bowl of the toilet to preclude a passage of fluid across a juncture of the nozzle conduit and the toilet bowl, the nozzle conduit being angled upward and terminating in a threaded distal end; and a nozzle head threadably coupled to the threaded distal end of the nozzle conduit for modifying fluid dispensed through the nozzle conduit;

wherein the nozzle head comprises a threaded cap having a transverse circular panel extending across the distal end of the nozzle conduit;

wherein each of the valves of the water supply means comprises a substantially cylindrical valve body, with the valve body adapted to receive and engage the respective toilet seat attaching bolt therewithin; and a handle extending from the valve body for effecting proportionate control of a volume of fluid through the valve.

3. The toilet bowl bidet attachment of claim 2, wherein the transverse circular panel includes a circular aperture directed through a center of the transverse circular panel, with an annular array of spray apertures extending through the transverse circular panel and positioned so as to extend about the center aperture.

4. The toilet bowl bidet attachment of claim 2, wherein the transverse circular panel includes an annular array of spray apertures directed therethrough.

5. The toilet bowl bidet attachment of claim 2, wherein the transverse circular panel comprises a circular screen extending across the threaded cap of the nozzle head.

6. A toilet bowl bidet attachment comprising:

a toilet having a toilet bowl;

a water supply means positioned in adjacency to the toilet bowl of the toilet for communicating with hot and cold water supply lines; and, a nozzle means positioned in fluid communication with the water supply means and extending through an aperture in the toilet bowl of the toilet for directing water from the water supply means onto a genital area of a user;

wherein the water supply means comprises a first valve mounted to a first toilet seat attaching bolt extending through the toilet to mount the first valve substantially behind and slightly beneath the toilet bowl of the toilet, the first valve being couplable to the hot water supply line; a hot water conduit of substantially arcuate configuration extending about the toilet bowl of the toilet beneath a rim thereof; a second valve mounted to a second toilet seat attaching bolt extending through the toilet to mount the second valve substantially behind and slightly beneath the toilet bowl of the toilet, the second valve being couplable to the cold water supply line; a cold water conduit of substantially arcuate configuration extending about the toilet bowl of the toilet beneath the rim thereof, the hot water conduit being in fluid communication with the cold water conduit, with the nozzle means extending into fluid communication with both the hot water conduit and the cold water conduit of the water supply means;

wherein the nozzle means comprises a nozzle conduit positioned in fluid communication with both the hot water conduit and the cold water conduit, the nozzle conduit extending through the aperture in the toilet bowl of the toilet; a grommet concentrically positioned about the nozzle conduit and extending through the aperture of the toilet to form a sealing engagement with the toilet bowl of the toilet to preclude a passage of fluid across a juncture of the nozzle conduit and the toilet bowl, the nozzle conduit being angled upward and terminating in a threaded distal end; and a nozzle head threadably coupled to the threaded distal end of the nozzle conduit for modifying fluid dispensed through the nozzle conduit;

wherein the nozzle head comprises a threaded cap having a transverse circular panel extending across the distal end of the nozzle conduit;

wherein each of the valves of the water supply means comprises a substantially cylindrical valve body, with the valve body receiving and engaging the respective toilet seat attaching bolt therewithin; and a handle extending from the valve body for effecting proportionate control of a volume of fluid through the valve.

7. The toilet bowl bidet attachment of claim 6, wherein the transverse circular panel includes a circular aperture directed through a center of a transverse circular panel, with an annular array of spray apertures extending through the transverse circular panel and positioned so as to extend about the center aperture.

8. The toilet bowl bidet attachment of claim 6, wherein the transverse circular panel includes an annular array of spray apertures directed therethrough.

9. The toilet bowl bidet attachment of claim 6, wherein the transverse circular panel comprises a circular screen extending across the threaded cap of the nozzle head.

10. The toilet bowl bidet attachment of claim 9, wherein the toilet rim is angled so as to direct fluids from an upper surface of the rim into the toilet bowl of the toilet, the rim upper surface of the rim being angled towards an interior of the toilet bowl.

* * * * *